US008678559B2

(12) United States Patent
Nakao

(10) Patent No.: US 8,678,559 B2
(45) Date of Patent: Mar. 25, 2014

(54) LIQUID EJECTING HEAD AND LIQUID EJECTING APPARATUS

(71) Applicant: Seiko Epson Corporation, Tokyo (JP)

(72) Inventor: Hajime Nakao, Azumino (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 13/751,371

(22) Filed: Jan. 28, 2013

(65) Prior Publication Data

US 2013/0194360 A1 Aug. 1, 2013

(30) Foreign Application Priority Data

Jan. 30, 2012 (JP) ..... 2012-017355

(51) Int. Cl.
*B41J 2/05* (2006.01)

(52) U.S. Cl.
USPC ..... 347/65

(58) Field of Classification Search
USPC ..... 347/54, 65, 66, 67, 70, 92
See application file for complete search history.

(56) References Cited

U.S. PATENT DOCUMENTS 8,360,567 B2 * 1/2013 Ito ..... 347/92
8,459,786 B2 * 6/2013 Ito ..... 347/92

FOREIGN PATENT DOCUMENTS

JP 2007-260948 10/2007

* cited by examiner

*Primary Examiner* — Anh T. N. Vo
(74) *Attorney, Agent, or Firm* — Harness, Dickey & Pierce, P.L.C.

(57) ABSTRACT

A liquid ejecting head includes a head body; and a flow path member having a liquid flow path circulating a liquid, supplied from a liquid storage unit, and a bubble chamber formed in the middle of the liquid flow path and in which air bubbles are caused to stay, wherein a compliance section (a sealing film) displaced according to a volume change in the air bubbles inside the bubble chamber is formed at upstream side of the bubble chamber so that an amount of the volume change in the compliance section due to the displacement of the compliance section is larger than an amount of a volume change in the air bubbles due to a change in the ambient temperature.

10 Claims, 4 Drawing Sheets

| PRECONDITION | |
|---|---|
| INITIAL TEMPERATURE | 25°C |
| AIR BUBBLE INITIAL VOLUME | 100 $mm^3$ |
| INK VOLUME IN CONTACT WITH AIR BUBBLE | 100 $mm^3$ |
| SATURATED WATER VAPOR PRESSURE OF INK | 80% OF WATER |

TEMPERATURE DEPENDENCE OF AIR BUBBLE VOLUME
(IN CASE OF INITIAL VOLUME 100 $mm^3$)

LIQUID EJECTING HEAD AND LIQUID EJECTING APPARATUS

BACKGROUND

1. Technical Field

The present invention relates to a liquid ejecting head and a liquid ejecting apparatus, in particular which are useful when applied to those having a bubble chamber in the middle of a flow path member.

2. Related Art

As a representive example of a liquid ejecting head ejecting liquid droplets, an ink jet type recording head ejecting ink droplets is exemplified. The ink jet type recording head has been suggested which includes, for example, a head body (a head body configured of a head case, a flow path unit and an oscillator unit) ejecting the ink droplets from a nozzle opening and a common flow path member which is fixed to the head body and supplies the ink to each head body from an ink cartridge that is a liquid storage section in which the ink is stored.

In the ink jet type recording head, the ink inside the ink cartridge is supplied to the head body via an ink flow path of the flow path member. The flow path member has a bubble chamber in which air bubbles included in the ink are stored and a filter downstream the bubble chamber, and the air bubbles are trapped in the bubble chamber so as to suppress defects such as a decreased effective area of the filter due to the blocked filter by the air bubbles (for example, see, JP-A-2007-260948).

However, since the air bubbles in the bubble chamber gradually grow and become large, the air bubbles grown excessively are periodically removed through head cleaning.

On the other hand, the air bubbles, which grow in the bubble chamber and then the volume of which increases, are further expanded, resulting from gas expansion due to a change in the ambient temperature, a change in the saturated water vapor pressure and a change in the solubility of the air with respect to the ink. As a result, when the pressure of the ink inside the ink flow path increases and the pressure inside the ink flow path exceeds meniscus withstand-pressure of the ink in the nozzle opening, the meniscus is destroyed.

In addition, when ejecting the liquid droplets via the nozzle opening, the destruction of the meniscus described above is not a problem. The reason is because the pressure inside the liquid flow path becomes a negative pressure whenever the liquid droplets are ejected and an increase in the pressure inside the flow path is suppressed by an increase in the volume of the air bubbles inside the bubble chamber. In addition, when the volume of the air bubbles inside the bubble chamber decreases due to the decrease in the ambient temperature, since the ink is supplied from the ink cartridge, the destruction of the meniscus does not occur due to the decrease in the pressure inside the flow path. Accordingly, the change in the ambient temperature causes the destruction of the meniscus within a non-use time in a state where the ejecting is stopped.

When the meniscus is destroyed due to the cause described above, there are problems in that a recording medium is damaged by the ink leakage from the nozzle opening and good printing results cannot be obtained.

In addition, the problems are simultaneously present not only in the ink jet type recording head, but also in the liquid ejecting head ejecting a liquid other than the ink and further simultaneously present in the flow path member which is utilized except for the liquid ejecting head.

SUMMARY

An advantage of some aspects of the invention is to provide a liquid ejecting head which can prevent the destruction of a meniscus at a nozzle opening by absorbing an increase in the pressure inside a liquid flow path, which is increased due to the increase in the volume of air bubbles inside a bubble chamber and is to provide a liquid ejecting apparatus using the same.

According to an aspect of the invention, there is provided a liquid ejecting head including: a head body which ejects liquid droplets via a nozzle opening using a pressure generated in a pressure generation chamber; and a flow path member which has a liquid flow path circulating a liquid, which is supplied from a liquid storage section, from an opening of one side thereof to an opening of the other side and supplying the liquid to the head body via the opening of the other side, and a bubble chamber which is formed in the middle of the liquid flow path and in which air bubbles are caused to stay, wherein a compliance section, which is displaced according to a volume change in the air bubbles inside the bubble chamber, is formed at upstream side of the bubble chamber so that an amount of the volume change in the compliance section due to the displacement of the compliance section is larger than an amount of a volume change in the air bubbles due to a change in the ambient temperature.

According to the aspect, an increased volume of the air bubbles inside the bubble chamber resulting from the change in the volume of the air due to the change in the ambient temperature, the change in the saturated water vapor pressure and the change in the solubility of the air can be absorbed by the change in the volume of the compliance section. As a result, the pressure acting on the meniscus of the nozzle opening can be maintained at the withstand-pressure thereof or less and destruction thereof can be prevented beforehand. Accordingly, the ink leakage from the nozzle opening due to the destruction of the meniscus can also be prevented.

Furthermore, in the aspect, the volume of a bubble buffer chamber, in which the maximum volume is defined in the relationship with the meniscus withstand-pressure in the related art, can be increased. Thus, the interval of the head cleaning, which is required for periodically removing air bubbles grown in the bubble buffer chamber, can be lengthened.

It is preferable that the amount of the displacement of the compliance section be set so that pressure inside the liquid flow path is smaller than a meniscus withstand-pressure of the liquid formed at the nozzle opening, when the temperature changes from a first temperature to a second temperature higher than the first temperature. According to the aspect, the destruction of the meniscus can be reliably prevented.

In addition, the compliance section may be disposed in the middle of the liquid flow path of the flow path member. According to the aspect, the pressure change can be absorbed by the increase of the volume of the air bubbles inside the flow path member. In this case, it is preferable that a self sealing valve, which performs opening and closing of the liquid flow path using variations in the pressure inside the liquid flow path, be disposed at the upstream side of the bubble chamber in the flow path member and the compliance section be formed using a film which is displaced so that the self sealing valve be open and closed by applying the atmospheric pressure to an surface of one side of the film and by applying the pressure inside the liquid flow path to an surface of the other side thereof. In this case, since the film can be served as an absorption element of the variations in the pressure due to the increase in the volume of the air bubbles inside the bubble chamber for opening and closing the self sealing valve, the film can provide a reasonable structure and can contribute to the miniaturization of the flow path member.

Meanwhile, the compliance section may be disposed at the liquid storage section or in the middle of a supply path from the liquid storage section to the flow path member. Also, in this case, the change in the volume of the air bubbles in the bubble chamber can be absorbed at the upstream side of the bubble chamber.

According to another aspect of the invention, there is provided a liquid ejecting apparatus including the liquid ejecting head described above.

According to the aspect, the influence of the increased the volume of the air bubbles inside the bubble chamber due to the change in the ambient temperature is removed so that a quality of media that is created by the liquid ejecting head can be improved. Such an effect can be remarkably obtained particularly when stopping the ejecting operation and non-use for a long time, in a case where the volume of the air bubbles increases due to the change in the ambient temperature is great.

In addition, since the volume of the bubble buffer chamber in the flow path member can be large, the interval of the head cleaning, which is required for periodically removing air bubbles grown in the bubble buffer chamber, can be lengthened and work efficiency in a predetermined work such as printing can be improved.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
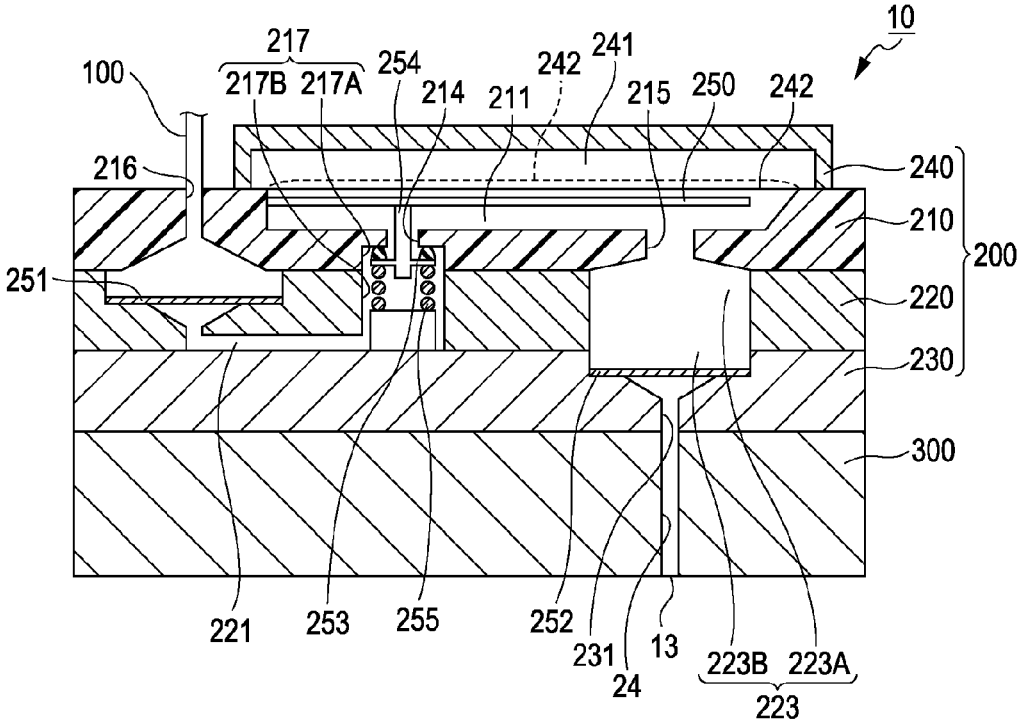
FIG. 1 is a cross-sectional view of a recording head according to an embodiment of the invention.

Hereinafter, an embodiment of the invention will be described in detail, based on the drawings. FIG. 1 is an explanatory view conceptually illustrating a recording head according to the embodiment of the invention. As illustrated in the same drawing, an ink jet type recording head 10 (hereinafter, referred to as a recording head) includes a flow path member 200 to which an ink is supplied from a storage unit (not illustrated in FIG. 1), which is configured of a tank in which the ink is stored, via an ink supply tube 100, and a head body 300 which ejects the ink supplied via the flow path member 200, via a nozzle opening 13.

The flow path member 200 includes a pressure chamber part 210, a first flow path part 220 and a second flow path part 230 as a flow path formation body having a unique shape formed in the thin plate, respectively, and a protection plate 240 having a substantially rectangular shape. Then, the flow path member 200 is integrally configured by laminating the second flow path part 230, the first flow path part 220 and the pressure chamber part 210 sequentially from bottom to top in the drawing, and further by overlapping the protection plate 240 on the pressure chamber part 210.

Among these, the protection plate 240 is fixed so as to be in contact with the upper surface of the pressure chamber part 210 and has a space 241 which is a concave section opening to the pressure chamber part 210 side. The space 241 is open to the atmosphere. In addition, in order to cover the space 241, a sealing film 242, which is a film member having a flexible thin film shape, is heat-welded to the opening of the protection plate 240 and then the space 241 is closed. The sealing film 242 is fixed to the protection plate 240 by applying pressure molding so that the sealing film 242 initially has a dome shape which is lightly bent to the inner side (to the lower side in the drawing).

The pressure chamber part 210 is a resin plate forming a rectangular shape in a plan view and a groove-shaped flow path 211 corresponding to the protection plate 240 is formed at the surface side thereof so as to extend in the longitudinal direction. When the protection plate 240 is bonded in the lamination direction on the pressure chamber part 210, the opening of the upper side in the protection plate 240 is sealed using the sealing film 242 fixed to the protection plate 240 so that a pressure chamber is formed between the groove-shaped flow path 211 and the sealing film 242. An inlet port 214 having a small diameter is formed to pass through one end side (the left end side in the drawing) of the groove-shaped flow path 211 and an outlet port 215 is formed to pass through the other end side (the right end side in the drawing). Furthermore, a liquid inlet port 216, to which the downstream end of the ink supply tube 100 is connected, is formed to pass through the left end portion of the pressure chamber part 210 in the drawing.

An elastic piece 250 configuring an operation lever is provided on the surface side of the pressure chamber part 210 so as to correspond to the groove-shaped flow path 211. Here, in the drawing, the left end portion of the elastic piece 250 is fixed to the pressure chamber part 210. In other words, the elastic piece 250 which functions as the operation lever is installed at the pressure chamber part 210 forming a cantilever shape at the upper position inside the groove-shaped flow path 211.

Meanwhile, in the lower surface side of the pressure chamber part 210 in the drawing, an upper valve accommodation section 217A is formed at a position corresponding to the inlet port 214 so as to position the corresponding inlet port 214 to the center thereof.

A filter 251 removing foreign materials in the ink flowed in via the liquid inlet port 216 is disposed at the first flow path part 220. Furthermore, a flow path 221 is formed at the first flow path part 220 so that the ink passing through the filter 251 is introduced in the groove-shaped flow path 211 via a lower valve accommodation section 217B which is integrated with the upper valve accommodation section 217A so as to form a valve accommodation section 217. In addition, an upper bubble chamber 223A, which is the upper portion of a bubble chamber 223, is formed at a position corresponding to the outlet port 215 of the first flow path part 220.

A lower bubble chamber 223B, which is a lower portion of the bubble chamber 223, is formed at the second flow path part 230 and a filter 252 is disposed at the downstream side thereof. The filter 252 captures foreign materials which cannot be captured in the filter 251 of the upstream side. In other words, the roughness of the mesh of the filter 252 is set to be capable of capturing the foreign materials smaller than the diameter of the nozzle opening 13 of the head body 300 and the filter 252 prevents an adverse effect beforehand in that the ink supplied from the flow path member 200 to the downstream side blocks the upstream end of the nozzle opening 13. In other words, the ink passing through the filter 252 is introduced in a flow path 24 of the head body 300 via the flow path 231.

Thus, in the flow path member 200, an ink circulating path is formed with the liquid inlet port 216, the flow path 221, the valve accommodation section 217, the inlet port 214, the groove-shaped flow path 211, the outlet port 215, the bubble chamber 223 and the flow path 231, through which the ink supplied from the liquid storage unit is circulated from the liquid inlet port 216 forming an opening of one side to the flow path 231 forming an opening of the other side.

A valve body 253 and a spring 255 are accommodated in the valve accommodation section 217. Here, the valve body 253 is biased upwards in the drawing by the spring 255. As a result, the inlet port 214 between the flow path 221 and the groove-shaped flow path 211 is usually closed by the valve body 253. A rod 254, which extends upwards in the drawing and the front end portion of which is in contact with the elastic piece 250 from below, is integrally fixed to the center portion of the valve body 253.

Thus, when the ink droplets are ejected via the nozzle opening 13 in a state where the inlet port 214 is closed by the valve body 253, an internal pressure of the groove-shaped flow path 211 or the like at the further downstream side than the valve body 253 becomes the negative pressure. As a result, the sealing film 242 presses the elastic piece 250 to the groove-shaped flow path 211 side due to the atmospheric pressure acting on the sealing film 242 via the space 241. As described above, the cantilever-shaped elastic piece 250 is pressed downwards in the drawing against the spring force of the spring 255 so that the inlet port 214 is opened and the ink is charged from the upstream side to the inside of the groove-shaped flow path 211 and the inside of the ink flow path at the downstream thereof via the inlet port 214. Accordingly, the internal pressure of the groove-shaped flow path 211 increases. As a result, the valve body 253 is pushed up integrally with the sealing film 242 by the spring force of the spring 255 and the inlet port 214 is closed again. Hereinafter, the same operation is repeated each time when the ink droplets are ejected. In other words, a self sealing valve, which automatically opens and closes the inlet port 214 using the valve body 253 each time when the ink droplets are ejected, is configured of the valve body 253, the rod 254, the spring 255, the elastic piece 250 and the sealing film 242.

The bubble chamber 223 is disposed at the upstream side of the filter 252 so that an effective area of the filter 252 is ensured by trapping the air bubbles, which grow due to the air bubbles dissolved in the ink, and the blocking of filter 252 due to the air bubbles is prevented. However, when the volume of the air bubbles in the bubble chamber 223 is increased, the internal pressure from the groove-shaped flow path 211 to the downstream side of the ink flow path is increased, in a state where the self sealing valve is closed due to the increased volume of the air bubbles. If the internal pressure exceeds the meniscus withstand-pressure at the nozzle opening 13, the meniscus is destroyed and the ink leaks to the outside via the nozzle opening 13. Here, the volume of the air bubbles trapped in the bubble chamber 223 varies due to the ambient temperature. Accordingly, in the embodiment, the expansion of the volume of the air bubbles due to the change in the ambient temperature is absorbed using the displacement of the sealing film 242. In other words, as a configuration element of the self sealing valve, the sealing film 242 of the embodiment is configured so as to perform the opening and closing operation of the inlet port 214 due to the pressure difference between the atmospheric pressure and the internal pressure in the ink flow path such as the groove-shaped flow path 211. In addition, the sealing film 242 acts as a compliance section to absorb the increased pressure according to the increased volume of the air bubbles inside the bubble chamber 223 due to the expansion as shown in a dot line in the drawing. In other words, as described above, the sealing film 242 of the embodiment is fixed to the protection plate 240 by applying the pressure molding so that the sealing film 242 initially has a dome shape which is lightly bent to the inner side (to the lower side in the drawing). Accordingly, the internal pressure inside the ink flow path can be kept constant even though the internal pressure inside the ink flow path is increased according to the increase in the ambient temperature. In this case, the volume of the air bubbles is increased in proportion to the ambient temperature according to the Charles' Law, but the increased volume is absorbed by the expansion of the sealing film 242.

When the temperature rises above the ambient temperature of the upper limit which can absorb the increased volume of the air bubbles at a constant pressure, the increase in the pressure due to the increased volume of the air bubbles can be absorbed by the expansion due to an elastic deformation of the sealing film 242. However, since a reaction force due to the elastic deformation in this case is applied to the ink inside the ink flow path such as the groove-shaped flow path 211, it is important to configure the pressure so as to be within the meniscus withstand-pressure. There is no problem if the configuration is provided such that the increased volume of the air bubbles with respect to the variations in the temperature between the minimum guaranteed operation temperature and the maximum guaranteed operation temperature can be absorbed by the sealing film 242, assuming of the toughest variations in the temperature in which the ambient temperature changes from the minimum guaranteed operation temperature to the maximum guaranteed operation temperature of the recording head 10. Here, the minimum guaranteed operation temperature may be, for example, substantially 0° C. to 10° C. and the maximum guaranteed operation temperature may be, for example, 50° C. to 60° C.

In short, in the embodiment, the amount of the displacement of the compliance section, which also serves as the sealing film 242, may be configured such that the pressure inside the ink flow path is lower than the meniscus withstand-pressure formed at the nozzle opening 13 in a case where the temperature changes from a predetermined first temperature to a predetermined second temperature higher than the first temperature.

Here, the increased volume of the air bubbles to be absorbed at the sealing film 242 is considered, based on a specific example. In this case, input parameters are illustrated in Table 1 and output parameters are illustrated in Table 2, respectively.

TABLE 1

| | | |
|---|---|---|
| Initial temperature | T0 | 25° C. |
| Temperature after non-use | T | 60° C. |
| Initial volume | V0 | 100 $mm^3$ |
| Ink volume | Vi | 100 $mm^3$ |

TABLE 2

| No | Calculation Article | | Formula | Symbol |
|---|---|---|---|---|
| 1 | Air bubble initial volume V0 | 100.0 $mm^3$ | | |
| 2 | Air bubble expansion volume ΔV | 11.7 $mm^3$ | =VO × (T/T − 1) | Air bubble initial volume: V0, Initial temperature: T0, Temperature after non-use: T |

TABLE 2-continued

| No | Calculation Article | | Formula | Symbol |
|---|---|---|---|---|
| 3 | Emission of dissolved air | 0.7 $mm^3$ | =(D0 − D) × Vi × T/273 | Solubility of gas at T0: D0, Solubility of gas at T: D |
| 4 | Difference in saturated water vapor | 13.4 kPa | =P − P0 | Saturated water vapor pressure of ink at T0: P0, Saturated water vapor pressure of ink at T: P |
| 5 | Volume increment of water vapor | 13.2 $mm^3$ | =(P − P0)/101.3 × V0 | |

In Table 2, Charles' Law was applied to the air bubble expansion volume ΔV at a constant pressure in a range in which the volume can be absorbed by expansion of the sealing film 242 (the compliance section). Emission of the dissolved air was calculated as the volume of an eluting gas volume (a solubility difference). However, since influence of the emission of the dissolved air is small compared to the other parameters, the emission of the dissolved air may be ignored in some cases. Difference in the saturated water vapor is an amount due to an increase in the partial water vapor pressure in the air by the difference in the saturated water vapor pressure. Here, since the amount of different gases other than the air are not changed, the volume is increased by the increase in the partial water vapor pressure. The volume increment of the water vapor is an amount obtained by converting the volume of the water vapor generated by the partial pressure difference.

As is clear from Table 2, in the present example, the gas increase that is the sum of the gas expansion volume ΔV, the emission of the dissolved air and the volume increment of the water vapor is 25.6 $mm^3$. As a result, the gas volume that is the sum of the air bubble initial volume V0 and the gas increase is 125.6 $mm^3$ and a growth rate that divides the gas increase by the gas volume is 20%.

Similarly, when the same calculation is performed for each temperature from 25° C. to 60° C., the result was obtained as in Table 3.

TABLE 3

| Temperature (° C.) | Volume ($mm^3$) |
|---|---|
| 25 | 100.0 |
| 30 | 102.5 |
| 40 | 108.7 |
| 60 | 125.6 |

Figure 2:
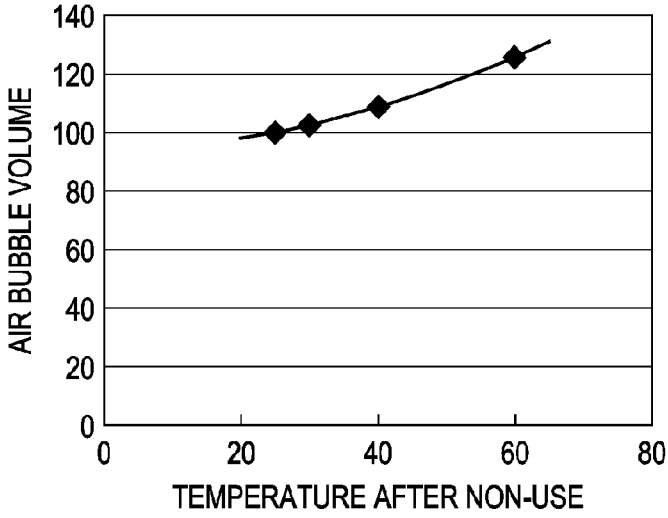
FIG. 2 is a characteristic diagram illustrating a relationship between a volume of air bubbles and a temperature after non-use.

FIG. 2 illustrates the characteristic diagram of the result in Table 3 as a relationship between the air bubble volume and the temperature after non-use. In this case, the saturated water vapor pressure of the ink was treated as 80% of the water.

According to the recording head 10 of the embodiment, the increased volume of the air bubbles within the bubble chamber 223 due to the change in the ambient temperature can be absorbed by the volume change in the sealing film 242 which also functions as the compliance section. As a result, the pressure acting on the meniscus of the nozzle opening 13 can be maintained within the withstand-pressure thereof and thereby the destruction thereof can be prevented beforehand.

Furthermore, according to the embodiment, since it is possible to increase the volume of the bubble chamber 223 in which the maximum volume is defined in the relationship with the meniscus withstand-pressure in the related art, intervals of the head cleaning, which is required for periodically removing air bubbles grown in the bubble chamber 223, can be lengthened.

Figure 3:
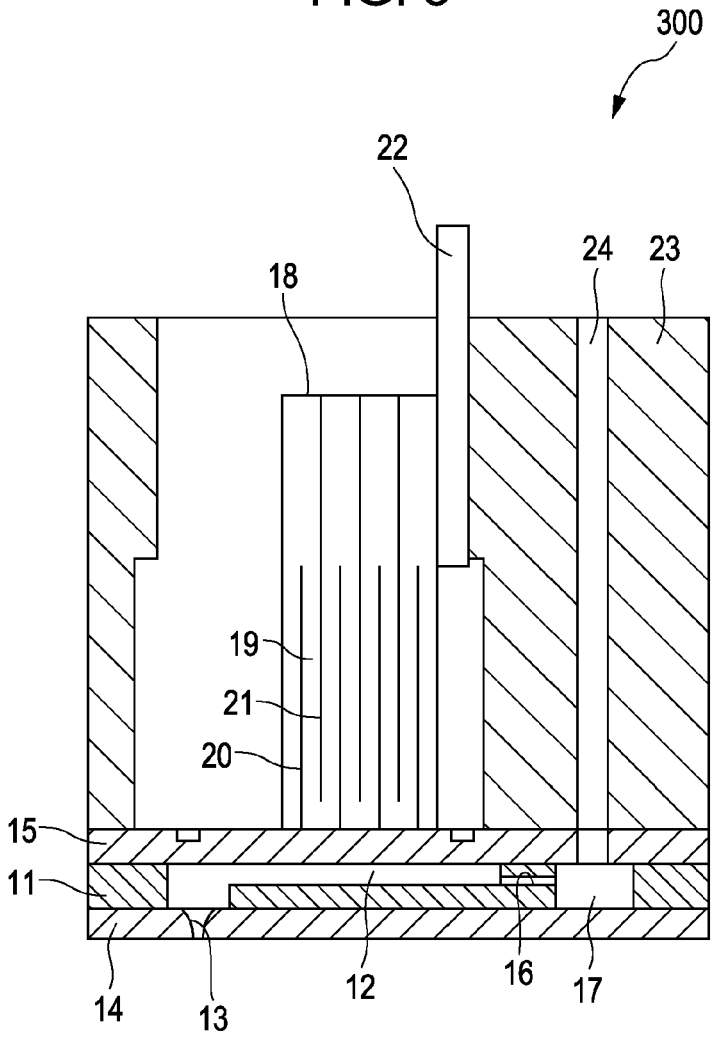
FIG. 3 is a cross-sectional view illustrating an example of a head body in the embodiment of the invention.

FIG. 3 is a cross-sectional view illustrating an example of the head body 300 fixed to the flow path member 200. As illustrated in the same drawing, the head body 300 of the present embodiment is a type having a vertically oscillating type piezoelectric element. In such a head body 300, a plurality of pressure generation chambers 12 are arranged in parallel on a flow path substrate 11 and both sides of the flow path substrate 11 are sealed by a nozzle plate 14 having a nozzle opening 13 corresponding to each pressure generation chamber 12, and a vibration plate 15. In addition, a manifold 17, which is a common ink chamber of the plurality of the pressure generation chambers 12 communicated with each of the pressure generation chambers 12 via an ink supply path 16 by being, is formed in the flow path substrate 11. An ink cartridge (not illustrated) is connected to the manifold 17.

On the other hand, a piezoelectric actuators 18 are provided at the opposite side of the vibration plate 15 to the pressure generation chambers 12 so that the front ends thereof are respectively in contact with a region corresponding to each pressure generation chamber 12. In the piezoelectric actuator 18, a piezoelectric material 19 and electrode forming materials 20 and 21 are laminated to be interposed alternately in tandem in a sandwich shape, and an inactive region, which does not contribute to the vibration, is fixed to a fixed substrate 22.

In the head body 300 configured as described above, the ink is supplied to the manifold 17 via the flow path 24 communicating with the flow path 231 of the flow path member 200 described above and is distributed to each pressure generation chamber 12 via the ink supply path 16. Then, the piezoelectric actuator 18 is contracted by applying the voltage to the piezoelectric actuator 18. Accordingly, the vibration plate 15 is deformed with the piezoelectric actuator 18 (pulled upward in the drawing), the volume of the pressure generation chambers 12 is expanded and the ink is drawn into the pressure generation chambers 12. Then, after the inside of the pressure generation chambers 12 is filled to the nozzle opening 13 with the ink, the piezoelectric actuator 18 is expanded and returns the original state if the voltage applied to the electrode forming materials 20 and 21 of the piezoelectric actuator 18 is removed according to the recording signal from the driving circuit. Thus, since the vibration plate 15 is also displaced and returns to the original state, the pressure generation chambers 12 is contracted and the ink droplets are ejected from the nozzle opening 13. In other words, in the embodiment, the vertically oscillating type piezoelectric actuator 18 is provided as a pressure generation unit which generates the pressure change in the pressure generation chambers 12.

ANOTHER EMBODIMENT

Hereinafter, the embodiment of the invention will be described. A basic configuration of the invention is not limited to the above description. For example, in the embodiment described above, the sealing film, which is the constituent element of the self sealing valve, also serves as the compliance section for absorbing the volume expansion of the air bubbles. However, of course, the compliance section, which has the same function, may be independently provided. In addition, such a compliance section is not necessarily arranged in the middle of the ink flow path of the flow path member 200 and the arrangement position thereof is not specifically limited if the compliance section is positioned at the upstream side of the bubble chamber 223. For example, the compliance section may be positioned inside the liquid storage unit 3. Here, the liquid storage unit is a so-called off-carriage type which communicates with the flow path member 200 via the ink supply tube 100. However, of course, the liquid storage unit may be a so-called on-carriage type such as the ink cartridge which is directly mounted on the flow path member 200. Even in this case, the compliance section may be arranged in the ink cartridge.

Further, in the embodiment described above, the pressure generation unit generating the pressure change in the pressure generation chambers 12 is described using the vertically oscillating type piezoelectric actuator 18. However, the invention is not particularly limited to the piezoelectric actuator 18 and, for example, a thin film type piezoelectric actuator may be used, in which a lower electrode, a piezoelectric layer, and an upper electrode are laminated using deposition and lithography method, or a thick film type piezoelectric actuator formed using a method may be used, which is formed using an attachment method of a green sheet. In addition, as the pressure generation unit, a unit may be used in which a heating element is disposed inside the pressure generation chambers 12 and the liquid droplets are ejected from the nozzle opening using the bubbles generated by heating of a heating element, or so-called an electrostatic actuator may be used, in which the liquid droplets are ejected from the nozzle opening by generating static electricity between the vibration plate and the electrode, and by deforming the vibration plate using an electrostatic force.

Figure 4:
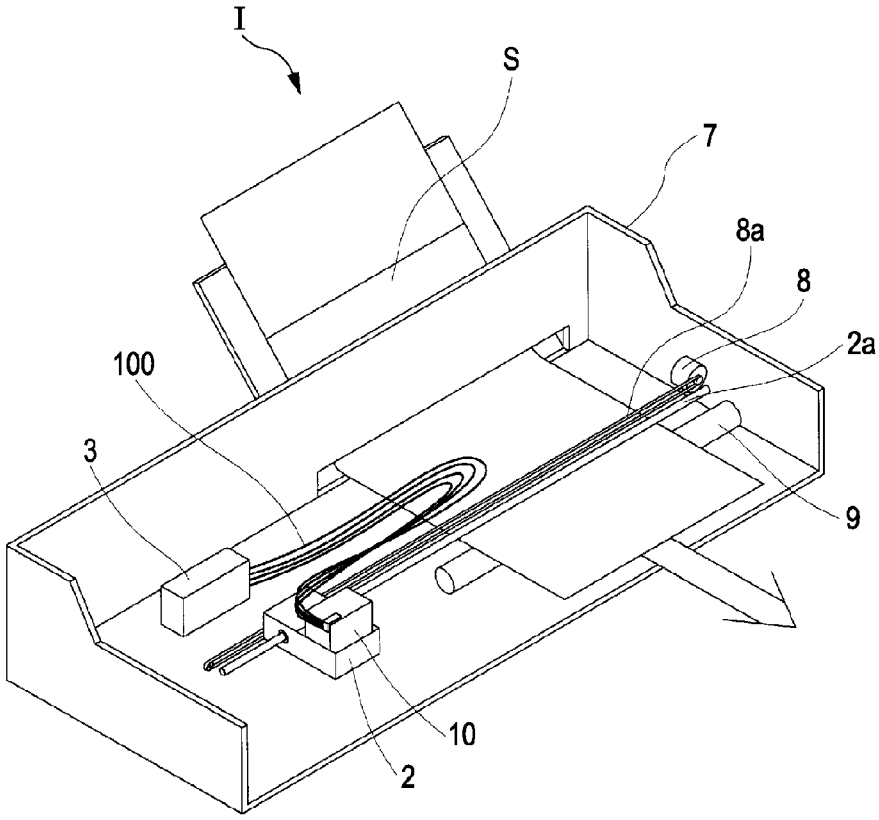
FIG. 4 is a schematic perspective view of a recording device according to the embodiment of the invention.

In addition, the ink jet type recording head 10 described above is mounted on the ink jet type recording apparatus. FIG. 4 is a schematic perspective view illustrating an example of the ink jet type recording apparatus. As illustrated in the same drawing, in the ink jet type recording apparatus I of the embodiment, the ink jet type recording head 10 is mounted on the carriage 2. Then, the carriage 2 on which the ink jet type recording head 10 is mounted is provided to be movable to a carriage shaft 2*a* attached to an apparatus body 7 in the axial direction.

In addition, the apparatus body 7 has the liquid storage unit 3 configured of a tank in which the ink is stored. The ink from the liquid storage unit 3 is supplied to the ink jet type recording head 10 mounted on the carriage 2 via the ink supply tube 100.

Then, the carriage 2 on which the ink jet type recording head 10 is mounted is moved along the carriage shaft 2*a* by transmitting the driving force of a driving motor 8 to the carriage 2 via a plurality of gears (not illustrated) and a timing belt 8*a*. On the other hand, a platen 9 is provided at the apparatus body 7 along the carriage shaft 2*a*. A recording sheet S that is a recording medium such as paper fed by a feed roller (not illustrated) or the like is transported, with being wound around the platen 9.

In the ink jet type recording apparatus I described above, the carriage 2 is moved along the carriage shaft 2*a*, the ink is ejected using the head body 300 of the ink jet type recording head 10, then printing is carried out on the recording sheet S.

In addition, in the ink jet type recording apparatus I described above, an example, in which the ink jet type recording head 10 is mounted on the carriage 2 and then moves in the main scanning direction, is described. However, the invention is not particularly limited to the example. For example, the invention may also be applied to so-called a line type recording apparatus, in which the ink jet type recording head 10 is fixed to the apparatus body 7 and the printing is carried out only by moving the recording sheet S such as the paper in a sub-scanning direction.

In the example described above, the ink jet type recording head 10 is described as an example of the liquid ejecting head, and the ink jet type recording apparatus I is described as an example of the liquid ejecting apparatus. However, the invention is widely intended for the whole liquid ejecting head, and the liquid ejecting apparatuses, and, of course, can be applied to a liquid ejecting head or a liquid ejecting apparatus ejecting the liquid in addition to the ink. The liquid ejecting head in addition thereto, for example, includes various recording heads used for an image recording apparatus such as a printer, a color material ejecting head used for producing the color filter of a liquid crystal display and the like, an electrode material ejecting head used for forming electrodes of an organic EL display, FED (Field Emission Display) and the like, a bioorganic matter ejecting head used for producing a bio chip, or the like, and can be also applied to a liquid ejecting apparatus including such a liquid ejecting head.

The entire disclosure of Japanese Patent Application No. 2012-017355, filed Jan. 30, 2012 is incorporated by reference herein.

What is claimed is:

1. A liquid ejecting head comprising:

a head body which ejects liquid droplets via a nozzle opening using a pressure generated in a pressure generation chamber; and a flow path member which has a liquid flow path circulating a liquid, which is supplied from a liquid storage unit in which the liquid is stored, from an opening of one side thereof to an opening of the other side and supplying the liquid to the head body via the opening of the other side, and a bubble chamber which is formed in the middle of the liquid flow path and in which air bubbles are caused to stay, wherein a compliance section, which is displaced according to a volume change in the air bubbles inside the bubble chamber, is formed at the upstream side of the bubble chamber so that an amount of the volume change in the compliance section due to the displacement of the compliance section is larger than an amount of a volume change in the air bubbles due to a change in the ambient temperature.

2. The liquid ejecting head according to claim 1, wherein the amount of the displacement of the compliance section is set so that pressure inside the liquid flow path is smaller than a meniscus withstand-pressure of the liquid formed at the nozzle opening, when the temperature changes from a first temperature to a second temperature higher than the first temperature.

3. A liquid ejecting apparatus comprising the liquid ejecting head according to claim 2.

4. The liquid ejecting head according to claim 1, wherein the compliance section is disposed in the middle of the liquid flow path in the flow path member.

5. A liquid ejecting apparatus comprising the liquid ejecting head according to claim 4.

6. The liquid ejecting head according to claim 1, wherein a self sealing valve, which performs opening and closing of the liquid flow path using variations in the pressure inside the liquid flow path, is disposed at the upstream side of the bubble chamber in the flow path member and the compliance section is formed using a film which is displaced so that the self sealing valve is open and closed by applying the atmospheric pressure to a surface of one side of the film and by applying the pressure inside the liquid flow path to a surface of the other side thereof.

7. A liquid ejecting apparatus comprising the liquid ejecting head according to claim 6.

8. The liquid ejecting head according to claim 1, wherein the compliance section is disposed at the liquid storage section or in the middle of a supply path from the liquid storage section to the flow path member.

9. A liquid ejecting apparatus comprising the liquid ejecting head according to claim 8.

10. A liquid ejecting apparatus comprising the liquid ejecting head according to claim 1.

* * * * *